US009162500B2

(12) United States Patent
Suzuki et al.

(10) Patent No.: US 9,162,500 B2
(45) Date of Patent: Oct. 20, 2015

(54) RECORDING MEDIUM TAKE-UP MECHANISM AND PRINTER

(71) Applicant: Roland DG Corporation, Hamamatsu-shi, Shizuoka (JP)

(72) Inventors: Nobuyoshi Suzuki, Hamamatsu (JP); Youichirou Ogawa, Hamamatsu (JP)

(73) Assignee: Roland DG Corporation, Shizuoka (JP)

( * ) Notice: Subject to any disclaimer, the term of this patent is extended or adjusted under 35 U.S.C. 154(b) by 0 days.

(21) Appl. No.: 14/390,091

(22) PCT Filed: Aug. 8, 2013

(86) PCT No.: PCT/JP2013/071521
§ 371 (c)(1),
(2) Date: Oct. 2, 2014

(87) PCT Pub. No.: WO2014/119031
PCT Pub. Date: Aug. 7, 2014

(65) Prior Publication Data

US 2015/0054895 A1 Feb. 26, 2015

(30) Foreign Application Priority Data

Jan. 31, 2013 (JP) ..... 2013-017389

(51) Int. Cl.
*B41J 2/01* (2006.01)
*B41J 15/16* (2006.01)
*B65H 23/16* (2006.01)

(52) U.S. Cl.
CPC ..... *B41J 15/16* (2013.01); *B41J 15/165* (2013.01); *B65H 23/16* (2013.01); *B65H 2801/03* (2013.01); *B65H 2801/12* (2013.01)

(58) Field of Classification Search
CPC ..... B41J 15/16; B41J 15/165; B65H 23/16; B65H 2801/03; B65H 2801/12
USPC ..... 347/102, 104, 101, 16
See application file for complete search history.

(56) References Cited

U.S. PATENT DOCUMENTS

2008/0253823 A1* 10/2008 Kanbara ..... 400/642
2011/0285801 A1 11/2011 Okura et al.
2012/0162334 A1 6/2012 Sasaki

FOREIGN PATENT DOCUMENTS

EP 0 096 494 A2 12/1983
JP 58-215391 A 12/1983

(Continued)

OTHER PUBLICATIONS

Official Communication issued in International Patent Application No. PCT/JP2013/071521, mailed on Sep. 17, 2013.

*Primary Examiner* — Henok Legesse
(74) *Attorney, Agent, or Firm* — Keating & Bennett, LLP

(57) ABSTRACT

A recording medium take-up mechanism and a printer prevent a recording medium having been printed from easily twisting when winding the recording medium. A printer includes a platen supporting recording paper that is delivered frontward during printing, a take-up shaft on which the recording paper having been printed is wound, a tension bar configured to impart tension to the recording paper by pressing a portion of the recording paper that is between the platen and the take-up shaft, a support arm supporting the tension bar, and a support shaft pivotably supporting the support arm. A center of the support shaft is positioned inside a contour of the take-up shaft, as viewed in an axial direction of the support shaft.

17 Claims, 7 Drawing Sheets

(56) References Cited

FOREIGN PATENT DOCUMENTS

| | | | |
|---|---|---|---|
| JP | 03-043271 | A | 2/1991 |
| JP | 2003-261121 | A | 9/2003 |
| JP | 2009-143147 | A | 7/2009 |
| JP | 2011-161783 | A | 8/2011 |
| JP | 2012-139822 | A | 7/2012 |
| WO | 20101087012 | A1 | 8/2010 |

* cited by examiner

RECORDING MEDIUM TAKE-UP MECHANISM AND PRINTER

BACKGROUND OF THE INVENTION

1. Field of the Invention

The present invention relates to a recording medium take-up mechanism and a printer.

2. Description of the Related Art

A printer having a rotatable take-up shaft has conventionally been known, which winds a recording medium, such as paper, onto the take-up shaft after printing. JP 2009-143147 A and WO/2010/087012 describe such a printer.

In JP 2009-143147 A and WO/2010/087012, the printer has a take-up shaft disposed below a platen, a cylindrical tension bar disposed frontward relative to the platen and the take-up shaft, and a pivotable support arm for supporting the tension bar. The tension bar imparts tension to the recording medium by pressing the back surface of the recording medium having been printed. The recording medium moves from the platen onto the tension bar, and thereafter it is wound around the take-up shaft. The support arm is pivotable about a support shaft that supports the support arm. As the support arm pivots about the support shaft, the tension bar swings about the support shaft. When the position of the tension bar is invariable, the tension imparted to the recording medium is constant. In the above-described printer, the rotation of the take-up shaft is controlled so that the position of the tension bar falls within a predetermined position range. This suppresses variations in the tension of the recording medium.

When the tension bar moves, the tension of the recording medium changes temporarily. In the conventional printers, the change in the tension of the recording medium is likely to be different from a portion of the recording medium to another. As a consequence, there has been a problem that the recording medium tends to be twisted easily when it is wound. When the recording medium is twisted, the problem arises that the recording medium cannot be wound around the take-up shaft in a desirable manner. Moreover, when the recording medium is twisted during winding, printing may not be carried out desirably because the recording medium is twisted on the platen.

SUMMARY OF THE INVENTION

Preferred embodiments of the present invention provide a recording medium take-up mechanism that does not allow a recording medium to be twisted easily when winding the recording medium, and also provide a printer including such a recording medium take-up mechanism.

A recording medium take-up mechanism according to a preferred embodiment of the present invention includes a take-up shaft on which a sheet-shaped recording medium is wound; a tension bar configured to impart tension to the recording medium by pressing a portion of the recording medium that is upstream of the take-up shaft; a support arm supporting the tension bar; and a support shaft pivotably supporting the support arm, wherein a center of the support shaft is positioned inside a contour of the take-up shaft as viewed in an axial direction of the support shaft.

A printer according to another preferred embodiment of the present invention includes a platen supporting a sheet-shaped recording medium that is delivered frontward during printing; a take-up shaft on which the recording medium having been printed is wound; a tension bar configured to impart tension to the recording medium by pressing a portion of the recording medium that is between the platen and the take-up shaft; a support arm supporting the tension bar; and a support shaft pivotably supporting the support arm, wherein a center of the support shaft is positioned inside a contour of the take-up shaft as viewed in an axial direction of the support shaft.

Various preferred embodiments of the present invention provide a recording medium take-up mechanism that does not allow a recording medium to be twisted easily when winding the recording medium, and a printer including such a recording medium take-up mechanism.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
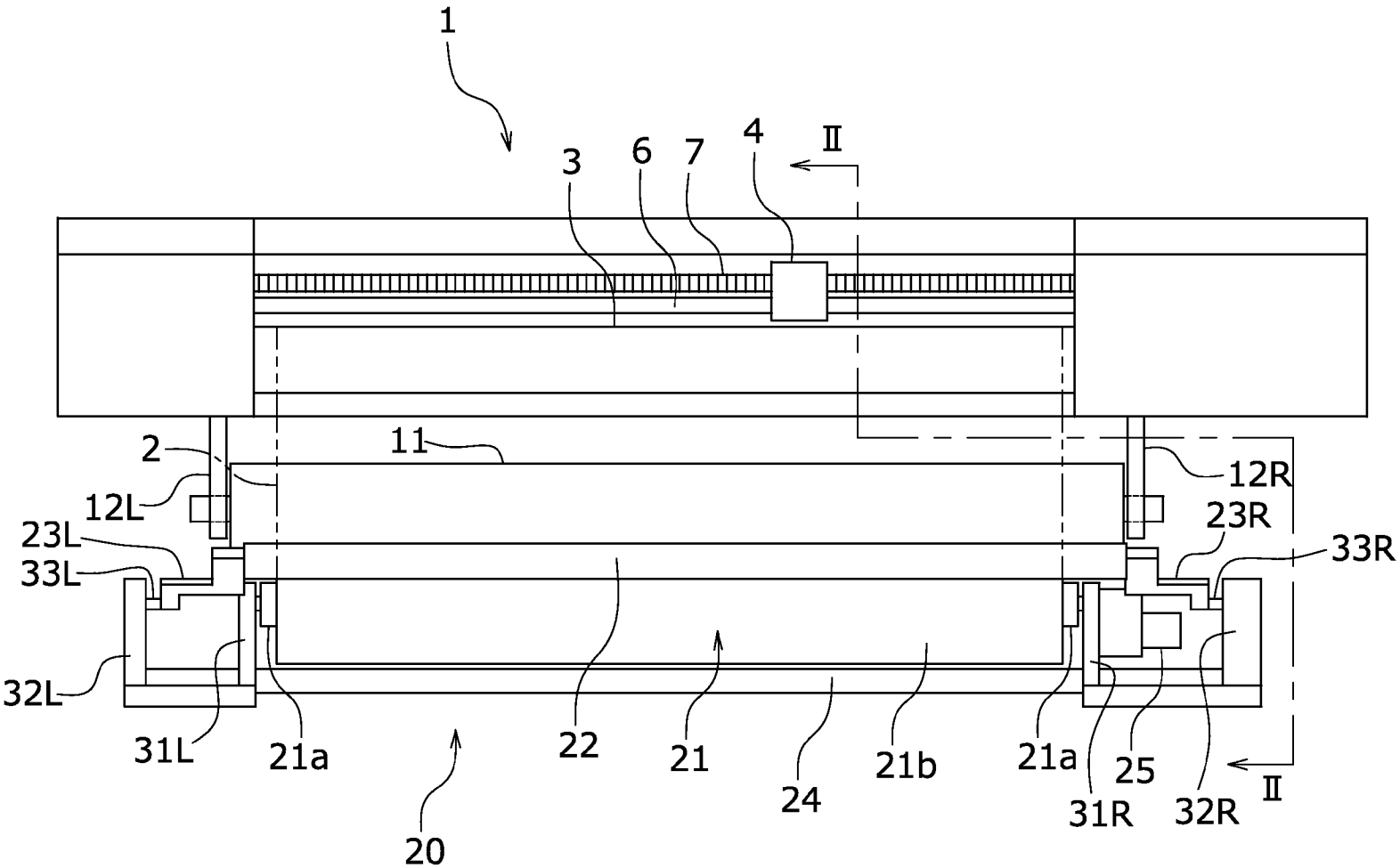
FIG. 1 is a front view of a printer according to a preferred embodiment of the present invention.
Figure 2:
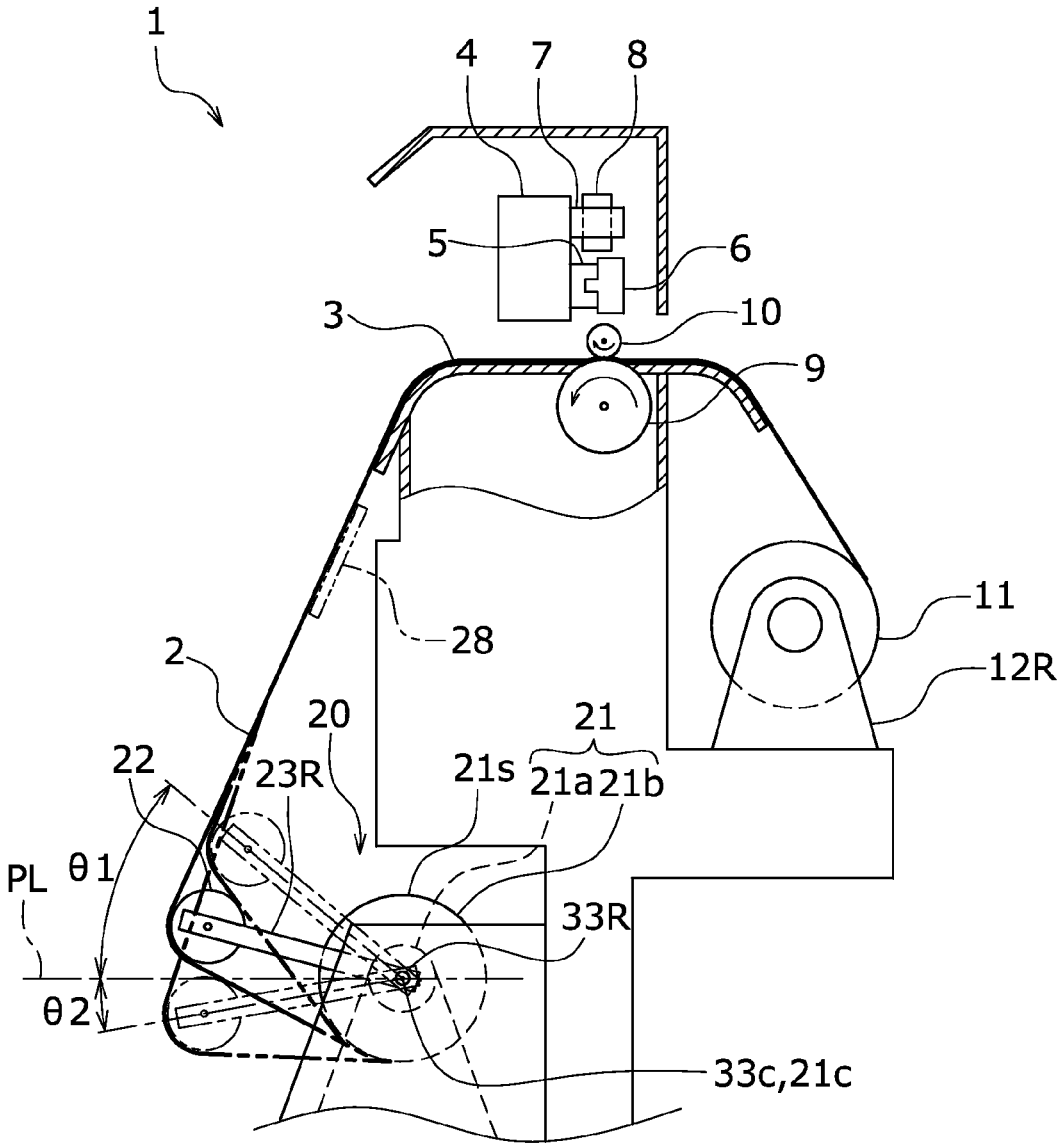
FIG. 2 is a cross-sectional view taken along line II-II of FIG. 1.

Hereinbelow, a printer 1 according to one preferred embodiment of the present invention will be described with reference to the drawings. FIG. 1 is a front view of the printer 1, and FIG. 2 is a cross-sectional view taken along line II-II of FIG. 1.

The printer 1 preferably is an inkjet-type printer that performs printing on recording paper 2, which is an example of a sheet-shaped recording medium. The recording medium is not limited to the recording paper as long as it can be wound on a later-described take-up shaft 21. The recording medium may be other media, such as a resin sheet and a cloth, for example. The printer 1 includes a platen 3 configured to support the recording paper 2 when printing. As illustrated in FIG. 2, an inkjet-type recording head 4 is disposed above the platen 3. Although not shown in the drawings, the recording head 4 includes a plurality of nozzles, which are open downward, and ejects ink from the nozzles. The type of the ink is not limited in anyway, and it may be an ink that is cured by ultraviolet light (so-called UV ink), a solvent ink, and the like. The printer 1 may include an irradiation device configured to emit ultraviolet, in addition to the recording head 4. The printer 1 may also include a cutting head configured to cut the recording medium. The type of the printer 1 is not limited in any way.

In the following description, the term "front" refers to the direction in which the recording paper 2 moves on the platen 3, and the term "rear" refers to the opposite direction thereto. As will be described later, the recording paper 2 is delivered frontward on the platen 3. In addition, the terms "left" and "right" in the following description refer to the left and the right, respectively, when the printer 1 is viewed from the front to the rear. It should be noted, however, that the above-mentioned terms indicating directions, front, rear, left, and right, are merely for convenience in illustration, and it is also possible to use other definitions.

A carriage 5 is fitted to the rear of the recording head 4. The carriage 5 is engaged with the guide rail 6 extending transversely. A belt 7 is fixed to the rear of the recording head 4. The belt 7 is wrapped around a drive pulley 8, which is disposed near the right end portion of the guide rail 6, and a driven pulley (not shown), which is disposed near the left end portion of the guide rail 6. As the drive pulley 8 rotates, the belt 7 runs, and the carriage 5 fixed to the belt 7 moves leftward or rightward. In accordance with the movement of the carriage 5, the recording head 4 also moves leftward or rightward. The recording head 4 is configured to eject ink while moving leftward and/or rightward.

The printer 1 includes a grid roller 9 as one example of a delivering unit configured to deliver the recording paper 2. The grid roller 9 is buried in the platen 3. An upper end portion of the grid roller 9 is exposed from the platen 3. A pinch roller 10 is disposed above the grid roller 9. Note that the grid roller 9 and the pinch roller 10 are not depicted in FIG. 1. The pinch roller 10 is configured to be movable upward and downward. When the pinch roller 10 moves downward, the recording paper 2 is pinched between the pinch roller 10 and the grid roller 9. By rotation of the grid roller 9 with the recording paper 2 being pinched between the pinch roller 10 and the grid roller 9, the recording medium 2 is delivered frontward.

As illustrated in FIG. 2, the printer 1 includes a feed shaft 11 configured to feed the recording paper 2. The feed shaft 11 is disposed behind the platen 3 and below the platen 3. In other words, the feed shaft 11 is disposed behind and obliquely below the platen 3. The recording paper 2 that has not yet been printed is wound around the feed shaft 11. As illustrated in FIG. 1, the left end portion of the feed shaft 11 is rotatably supported by a left guide plate 12L, and the right end portion of the feed shaft 11 is rotatably supported by a right guide plate 12R. The printer 1 may include a motor configured to rotate the feed shaft 11. However, in the present preferred embodiment, such a motor preferably is not provided. The grid roller 9 delivers the recording paper 2 frontward, so the recording paper 2 is sent out from the feed shaft 11.

As illustrated in FIG. 2, a front portion of the platen 3 inclines obliquely downward. As indicated by the virtual line in FIG. 2, a heater 28 configured to accelerate drying of the recording paper 2 may be provided in front of and obliquely below the platen 3. By heating the recording paper 2 that has been printed on with the heater 28, the ink on the recording paper 2 is cured quickly, so the quality of printing is improved.

As illustrated in FIG. 2, the printer 1 includes a take-up mechanism 20 configured to wind the recording paper 2 that has been printed. Next, the structure of the take-up mechanism 20 will be described below.

The take-up mechanism 20 includes a take-up shaft 21 configured to wind the recording paper 2, a tension bar 22 configured to impart tension to the recording paper 2, and support arms 23L and 23R supporting the tension bar 22.

Figure 3:
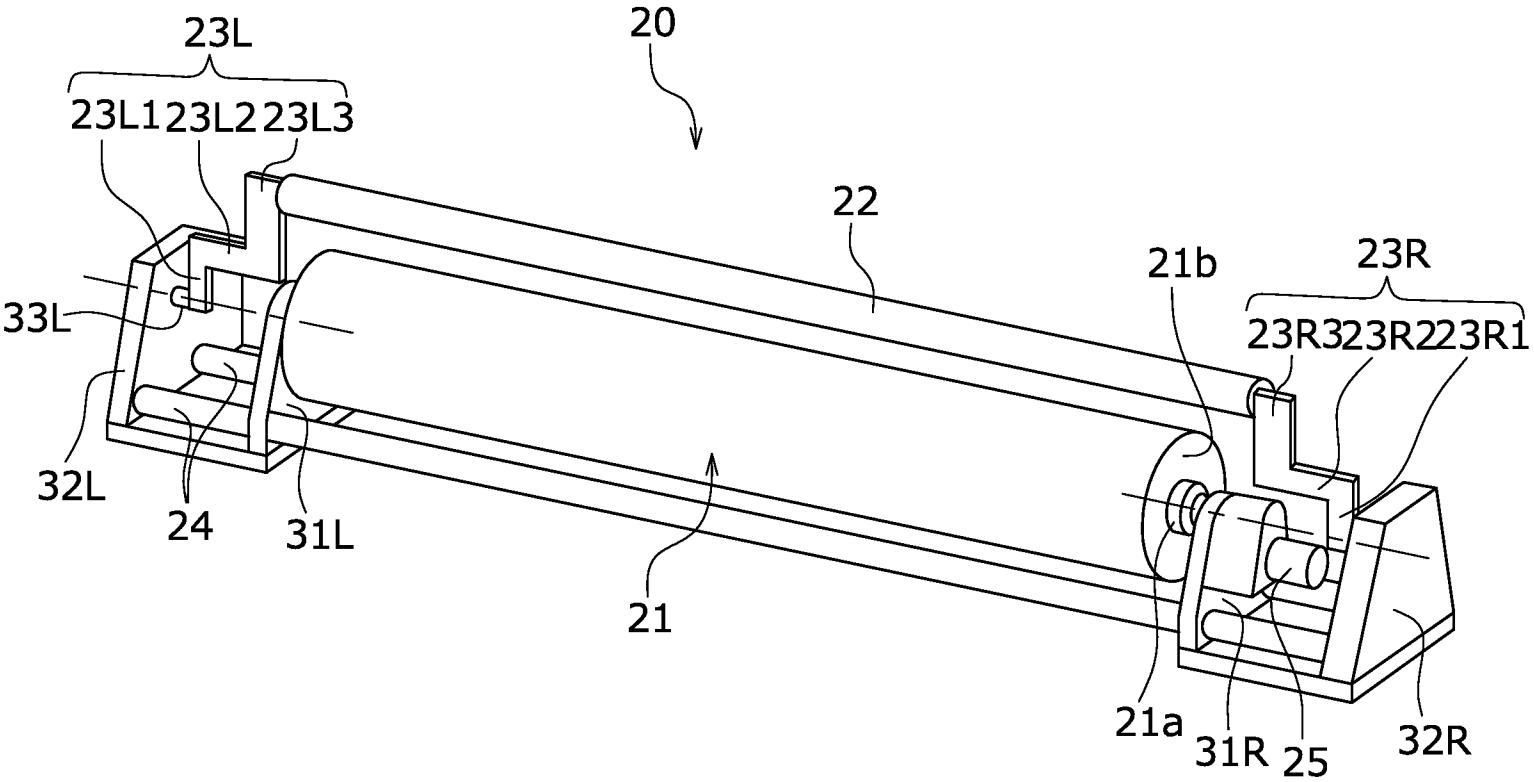
FIG. 3 is a perspective view of a take-up mechanism.

As illustrated in FIG. 1, the take-up shaft 21 preferably has a tubular or cylindrical shape extending transversely. The take-up shaft 21 is disposed downward relative to the platen 3. The printer 1 includes a first left side wall 31L and a first right side wall 31R, which rotatably support the take-up shaft 21. The take-up shaft 21 includes a support portion 21*a* supported by the first left side wall 31L and the first right side wall 31R, and a cylindrical portion 21*b* having a diameter larger than the support portion 21*a*. The recording paper 2 is wound onto the cylindrical portion 21*b*. The support portion 21*a* and the cylindrical portion 21*b* may be formed either integrally with each other or may be formed separately. The left end portion of the take-up shaft 21 is rotatably supported by the first left side wall 31L, and the right end portion of the take-up shaft 21 is rotatably supported by the first right side wall 31R. The printer 1 includes rails 24 that support the first left side wall 31L and the first right side wall 31R. As illustrated in FIG. 3, the rails 24 extend transversely, one in front and one behind, so as to form a pair. The first left side wall 31L and the first right side wall 31R are slidably fitted to the rails 24. The gap between the first left side wall 31L and the first right side wall 31R are capable of being adjusted by moving the first left side wall 31L and the first right side wall 31R so as to come closer to each other or separate away from each other along the rails 24. Thus, take-up shafts 21 with different lengths may be appropriately selected according to the transverse width of the recording paper 2 and installed thereto.

The tension bar 22 preferably has a tubular shape or a cylindrical shape extending transversely. The tension bar 22 is disposed parallel or substantially parallel to the take-up shaft 21. Although the tension bar 22 may be rotatable, the tension bar 22 preferably is configured to be non-rotatable in the present preferred embodiment. The tension bar 22 may include tension rollers that rotate according to the movement of the recording paper 2, for example. The tension bar 22 preferably is longer than the take-up shaft 21. However, the length of the tension bar 22 may be equal to the length of the take-up shaft 21, or may be shorter than the length of the take-up shaft 21. As illustrated in FIG. 2, the tension bar 22 is disposed downward relative to the platen 3. The tension bar 22 is disposed frontward relative to the platen 3 and the take-up shaft 21.

As illustrated in FIG. 3, the printer 1 includes a second left side wall 32L, which is positioned to the left of the first left side wall 31L, and a second right side wall 32R, which is positioned to the right of the first right side wall 31R. The left support arm 23L is pivotably supported on the second left side wall 32L, and the right support arm 23R is pivotably supported on the second right side wall 32R. More specifically, a left support shaft 33L is provided on a right side portion of the second left side wall 32L, and a right support shaft 33R (see FIG. 1) is provided on a left side portion of the second right side wall 32R. The left support arm 23L is pivotably supported about the left support shaft 33L, and the right support arm 23R is pivotably supported about the right support shaft 33R. The left support shaft 33L and the right support shaft 33R may be formed either separately from or integrally with the left support arm 23L and the right support arm 23R, respectively.

As illustrated in FIG. 3, the support arms 23L and 23R preferably are substantially angular S-shapes. More specifically, the left support arm 23L includes a first vertical arm portion 23L1 connected to the left support shaft 33L and extending upward, a horizontal arm portion 23L2 extending rightward from the first vertical arm portion 23L1, and a second vertical arm portion 23L3 extending upward from the horizontal arm portion 23L2. On the other hand, the right support arm 23R includes a first vertical arm portion 23R1 connected to the right support shaft 33R and extending upward, a horizontal arm portion 23R2 extending leftward from the first vertical arm portion 23R1, and a second vertical arm portion 23R3 extending upward from the horizontal arm portion 23R2.

A motor 25 coupled to the take-up shaft 21 is disposed between the first right side wall 31R and the second right side wall 32R. The motor 25 is connected indirectly to the take-up shaft 21 via a reduction gear or the like, which is not shown in the drawings. The take-up shaft 21 rotates by receiving the drive power of the motor 25. The motor 25 is disposed so as to be positioned below the horizontal arm portion 23R2 when the right support arm 23R is brought vertically upright. During printing, the right support arm 23R takes a posture such as to extend frontward and obliquely upward, to extend frontward, or to extend frontward and obliquely downward. During printing, the motor 25 is positioned behind the right support arm 23R. It is also possible to dispose the motor 25 between the first left side wall 31L and the second left side wall 32L. In this case, the motor 25 may be disposed so as to be positioned behind the horizontal arm portion 23L2 during printing.

Next, the positional relationship between the support shafts 33L, 33R and the take-up shaft 21 as viewed in the axial direction will be described below. The positional relationship between the support shaft 33L and the take-up shaft 21 is the same as the positional relationship between the support shaft 33R and the take-up shaft 21, so the following description describes the positional relationship between the support shaft 33R and the take-up shaft 21. As illustrated in FIG. 2, the support shaft 33R is positioned inside the contour 21*s* of the take-up shaft 21 as viewed in the axial direction of the support shaft 33R, in other words, as viewed from the side. Herein, the term "contour" refers to the line that defines the external shape of the take-up shaft 21. In the present preferred embodiment, the take-up shaft 21 includes the support portion 21*a* and the cylindrical portion 21*b*, and the circumferential surface of the cylindrical portion 21*b* defines the external shape of the take-up shaft 21 as viewed from the side. In the present preferred embodiment, as viewed from the side, the contour of the cylindrical portion 21*b* is the contour 21*s* of the take-up shaft 21. As viewed from the side, the support shaft 33R is positioned within the range less than or equal to the radius of the take-up shaft 21 from the center of the take-up shaft 21, so the distance between the center 33*c* of the support shaft 33R and the center 21*c* of the take-up shaft 21 is close. As viewed from the side, the center 33*c* of the support shaft 33R may be positioned inside the contour of the support portion 21*a* of the take-up shaft 21. In the present preferred embodiment, the center 33*c* of the support shaft 33R and the center 21*c* of the take-up shaft 21 are located at the same position or substantially the same position as viewed from the side. The position of the center 33*c* of the support shaft 33R and the position of the center 21*c* of the take-up shaft 21 may be incomplete agreement with each other or may be in slight disagreement with each other. For example, it is possible that the center 33*c* of the support shaft 33R and the center 21*c* of the take-up shaft 21 are not aligned at the same position as viewed from the side such that a distance between the center 33*c* and the center 21*c* may be less than or equal to the radius of the support shaft 33R.

Figure 4:
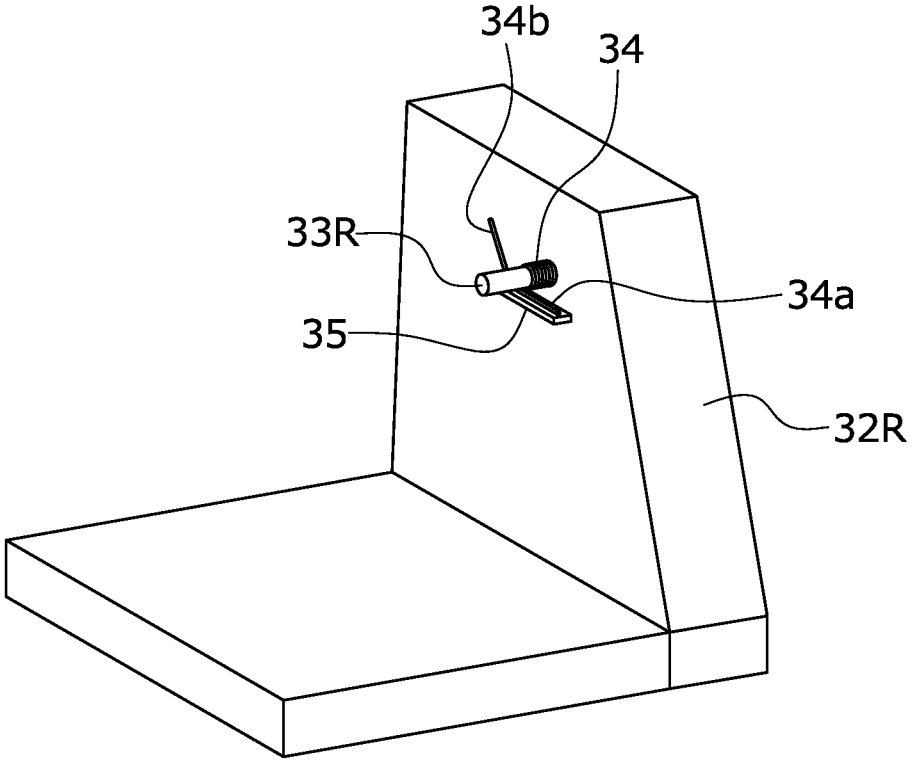
FIG. 4 is a perspective view illustrating a support shaft, a torsion spring, and so forth.

FIG. 4 is a perspective view of the second right side wall 32R from which the support arm 23R is removed, when viewed diagonally from the front left. As illustrated in FIG. 4, a torsion spring 34 is fitted to the support shaft 33R. An interlocking portion 35 interlocking with one end 34*a* of the torsion spring 34 is provided at a left side portion of the second right side wall 32R. Although not shown in the drawings, the other end 34*b* of the torsion spring 34 is interlocked with the support arm 23R. The torsion spring 34 is configured to impart a force to the support arm 23R in a direction such as to pivot it upward. Although not shown in the drawings, a similar torsion spring 34 is fitted to the support shaft 33L on the second left side wall 32L, and this torsion spring 34 is configured to impart a force to the support arm 23L in a direction such as to pivot it upward.

As illustrated in FIG. 2, the right support arm 23R is pivotable about the center 33*c* of the right support shaft 33R. Although not shown in the drawings, the left support arm 23L is pivotable about the center 33*c* of the left support shaft 33L. In accordance with the pivot movement of the support arms 23L and 23R, the tension bar 22 swings about the centers 33*c* of the support shafts 33L and 33R. The support arms 23L and 23R are configured to receive an upward force from the torsion springs 34. The force of the torsion springs 34 is less than the total of the weights of the support arms 23L and 23R and the tension bar 22. For this reason, a downward force acts on the tension bar 22. Because the tension bar 22 swings about the centers 33*c* of the support shaft 33L and 33R, the just-mentioned force of the tension bar 22 becomes a force that presses the recording paper frontward, or frontward and obliquely downward. Thus, the tension bar 22 presses the recording paper 2, and as a result, tension occurs in the recording paper 2.

Next, the operation of the take-up mechanism 20 will be described below. During printing with the printer 1, the recording paper 2 is delivered frontward by the grid roller 9. The tension bar 22 imparts tension to the recording paper 2 that has been printed, which prevents the recording paper 2 from being bent or twisted.

The take-up shaft 21 is driven appropriately by the motor 25. As the take-up shaft 21 rotates, the recording paper 2 moves from the tension bar 22 to the take-up shaft 21, and it is wound around the take-up shaft 21. More specifically, when the tension bar 22 moves downward beyond a predetermined position or position range, the motor 25 is driven to rotate the take-up shaft 21. Then, the recording paper 2 is wound onto the take-up shaft 21, and the tension bar 22 receives a force from the recording paper 2 and moves upward. When the tension bar 22 moves upward beyond a predetermined position or position range, the motor 25 stops, and the rotation of the take-up shaft 21 stops. When the rotation of the take-up shaft 21 stops, the tension bar 22 moves downward while pressing the recording paper 2 frontward. Thereafter, the foregoing operation is repeated. By such an operation, the recording paper 2 is wound around the take-up shaft 21.

It should be noted that the position of the tension bar 22 preferably is detected based on the pivot angle of the support arms 23L and 23R. Although not shown in the drawings, the printer 1 according to the present preferred embodiment includes a sensor configured to detect the pivot angle of the support arm 23L or 23R, and a controller configured and programmed to control the motor 25 based on a signal from the sensor. The operation of the take-up shaft 21 is controlled by the just-mentioned controller. It should be noted, however, that the operation of the take-up shaft 21 is not particularly limited, and various other methods of operation can be used, for example.

The positions of the support arms 23L and 23R that serve as the reference to turn on/off the motor 25 are not particularly limited. For example, the support arms 23L and 23R may be configured so as to pivot between a position at an angle of about 45 degrees downward and a position at an angle of about 45 degrees upward from the horizontal line PL, as viewed in the axial direction of the support shafts 33L and 33R, during printing with the printer 1. In the present preferred embodiment, the support arms 23L and 23R are configured so as to pivot between a position at an angle θ1 upward and a position at an angle θ2 downward from the horizontal line PL during printing with the printer 1. The angle θ1 may be less than 45 degrees, and the angle θ2 may be less than 45 degrees, for example.

Figure 5A:
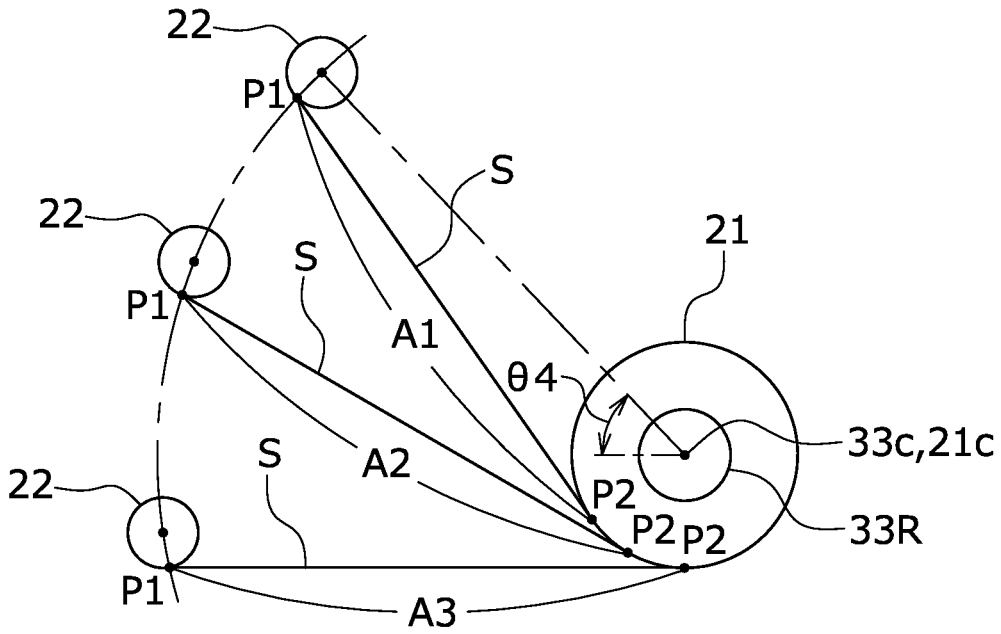
FIG. 5A is a view schematically illustrating the pre-winding length of a recording paper when a position of the center of the support shaft and a position of the center of a take-up shaft are in agreement with each other.

As described previously, a position of the center 33*c* of the support shafts 33L and 33R and a position of the center 21*c* of the take-up shaft 21 preferably are in agreement with each other in the printer 1 according to the present preferred embodiment. It should be noted that, because the center 33*c* of the support shaft 33L and the center 33*c* of the support shaft 33R are located at the same position or substantially the same position as viewed from the side, only the center 33*c* of the support shaft 33R will be discussed in the following. As illustrated in FIG. 5A, the points at which the common tangent S between the contour of the tension bar 22 and the contour of the take-up shaft 21 intersects the contour of the tension bar 22 and the contour of the take-up shaft 21 are defined as point P1 and P2, respectively. In this case, when a position of the center 33*c* of the support shaft 33R and a position of the center 21*c* of the take-up shaft 21 are in agreement with each other, the distance between point P1 and point P2 is invariable irrespective of the position of the tension bar 22. In other words, A1=A2=A3, when the center 33*c* of the support shaft 33R and the center 21*c* of the take-up shaft 21 are located at the same position. Here, point P1 can be regarded as the position at which the recording paper 2 is separated away from the tension bar 22, and point P2 can be regarded substantially as the position at which the recording paper 2 starts to be wound around the take-up shaft 21. Therefore, the distance between point P1 and point P2 can be regarded as the length of the recording paper 2 between the tension bar 22 and the take-up shaft 21 (hereinafter referred to as "pre-winding length"). In the printer 1 according to the present preferred embodiment, the pre-winding length of the recording paper 2 becomes invariable irrespective of the position of the tension bar 22.

Figure 5B:
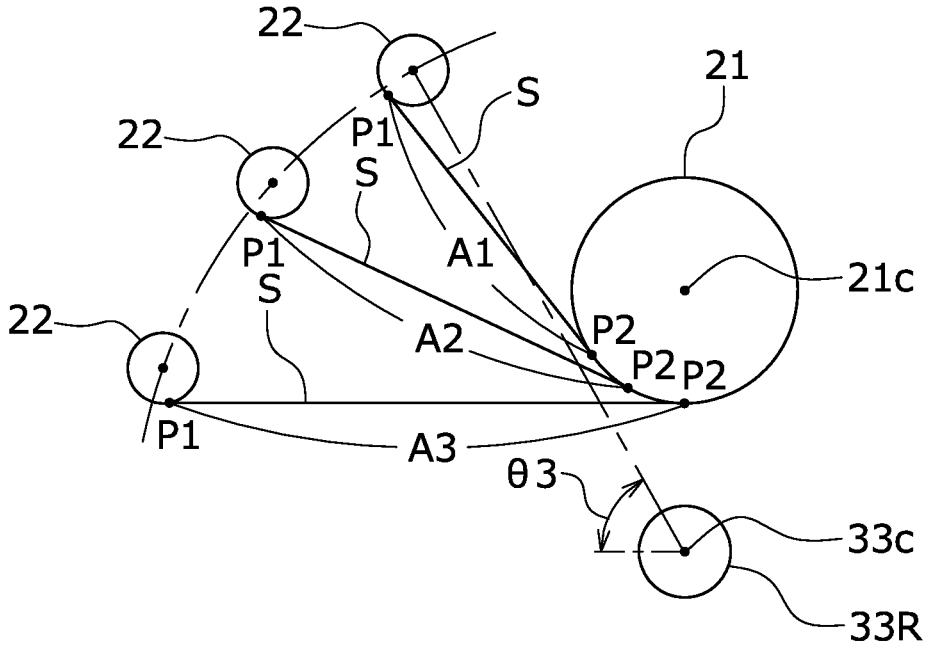
FIG. 5B is a view schematically illustrating the pre-winding length of a recording paper when the support shaft is positioned downward relative to the take-up shaft.

On the other hand, as illustrated in FIG. 5B, when a position of the center 33*c* of the support shaft 33R and a position of the center 21*c* of the take-up shaft 21 are in disagreement with each other, the distance between point P1 and point P2 varies depending on the position of the tension bar 22. As illustrated in FIG. 5B, for example, when the support shaft 33R is positioned downward relative to the take-up shaft 21, the distance between point P1 and point P2 becomes longer as the tension bar 22 swings more downward from above about the center 33*c* of the support shaft 33R. In other words, A1<A2<A3. Therefore, the pre-winding length of the recording paper 2 varies depending on the position of the tension bar 22. The amount of variation in the pre-winding length of the recording paper 2 is greater as the distance between the center 33*c* of the support shaft 33R and the center 21*c* of the take-up shaft 21 is longer.

As described previously, the tension bar 22 moves frequently when winding the recording paper 2. For this reason, the pre-winding length of the recording paper 2 changes frequently in the example shown in FIG. 5B. At that time, the tension of the recording paper 2 changes locally, and a difference in the tension tends to arise between the left side portion and the right side portion of the recording paper 2. When such a difference in the tension arises, the recording paper 2 is likely to be twisted easily.

Figure 6A:
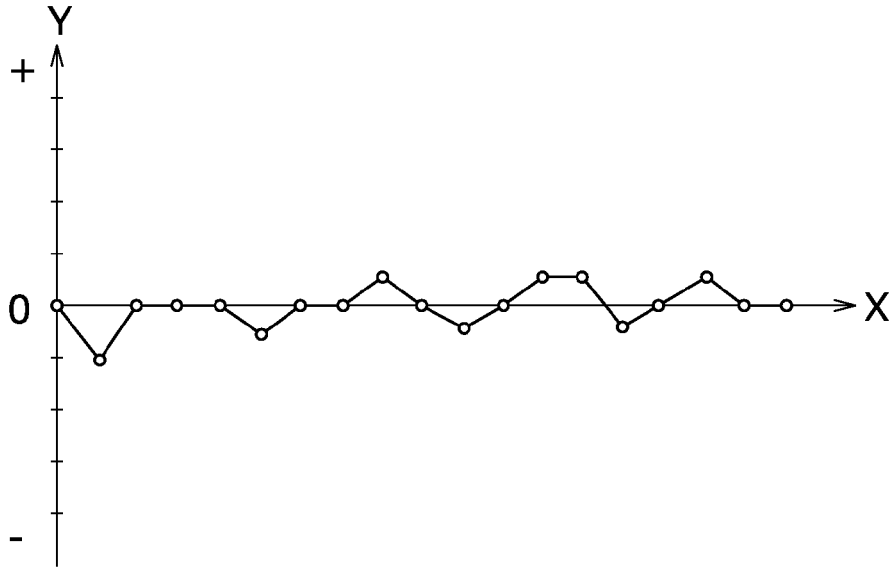
FIG. 6A is a graph showing the results of an experiment conducted to investigate a degree of twisting of recording paper, which shows the case where a position of the center of the support shaft and a position of the center of the take-up shaft are in agreement with each other.
Figure 6B:
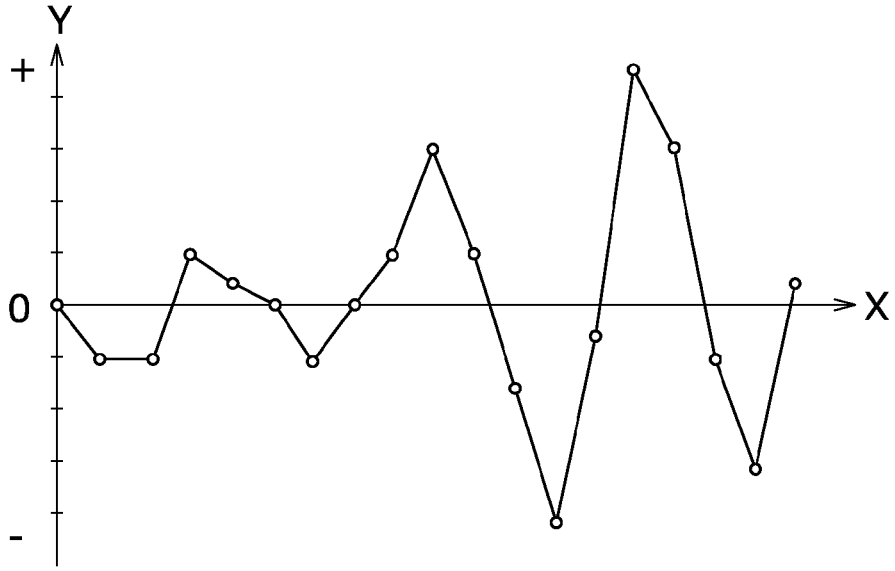
FIG. 6B is a graph showing the results of the experiment conducted to investigate a degree of twisting of recording paper, which shows the case where the support shaft is positioned downward relative to the take-up shaft.

FIGS. 6A and 6B show the results of the experiment conducted to investigate a degree of twisting of recording paper 2. In this experiment, how the position of the right end of the recording paper 2 deviates to the left or the right was investigated at a predetermined position of the recording paper 2 between the tension bar 22 and the take-up shaft 21. FIG. 6A shows the case in which a position of the center 33*c* of the support shaft 33R and a position of the center 21*c* of the take-up shaft 21 are in agreement with each other (see FIG. 5A). FIG. 6B shows the case in which the support shaft 33R deviates downward from the take-up shaft 21 (see FIG. 5B). In each of FIGS. 6A and 6B, the horizontal axis represents the amount X of the recording paper 2 that has been delivered since the start of the measurement, and the vertical axis represents the transverse position Y of the right end of the recording paper 2. The position Y becomes a positive value when the right end of the recording paper 2 deviates to the right, and it becomes a negative value when the right end of the recording paper 2 deviates to the left. As is clear from the comparison between FIGS. 6A and 6B, the degree of twisting of the recording paper 2 becomes less when a position of the center 33*c* of the support shaft 33R and a position of the center 21*c* of the take-up shaft 21 are in agreement with each other.

Thus, in the printer 1 according to the present preferred embodiment, the center 33*c* of the support shaft 33R is positioned inside the contour 21*s* of the take-up shaft 21 as viewed in the axial direction of the support shaft 33R, as illustrated in FIG. 2. The center 33*c* of the support shaft 33R and the center 21*c* of the take-up shaft 21 are close to each other. Therefore, even though the tension bar 22 moves up and down during winding, the amount of variation in the pre-winding length of the recording paper 2 is small. As a result, the twisting of the recording paper 2 is significantly reduced or prevented. If the recording paper 2 is twisted during winding, printing may not be carried out desirably because the recording paper 2 is twisted on the platen 3. However, the printer 1 according to the present preferred embodiment significantly reduces or prevents the twisting of the recording paper 2 during winding. Therefore, it becomes possible to wind the recording paper 2 around the take-up shaft 21 appropriately and also carry out desirable printing stably.

In particular, in the present preferred embodiment, a position of the center 33*c* of the support shaft 33R and a position of the center 21*c* of the take-up shaft 21 are substantially in agreement with each other, as viewed in the axial direction of the support shaft 33R. Therefore, the amount of variation in the pre-winding length of the recording paper 2 is significantly reduced or prevented to a greater extent. The twisting of the recording paper 2 is significantly reduced or prevented to a greater extent, and more desirable printing is carried out.

As illustrated in FIG. 2, the tension bar 22 is disposed frontward relative to the platen 3, and the support shafts 33L and 33R that pivotably support the support arms 23L and 23R are positioned rearward relative to a portion of the recording paper 2 that is in contact with the tension bar 22. Such a configuration makes it possible to impart sufficient tension to the recording paper 2 and also obtain the above-described advantageous effects more significantly. As a result, the twisting of the recording paper 2 is significantly reduced or prevented more effectively.

In addition, in the present preferred embodiment, the support arms 23L and 23R, as well as the support shafts 33L and 33R, are positioned rearward relative to the portion of the recording paper 2 that is in contact with the tension bar 22.

With such a configuration, the support arms 23L and 23R are positioned inside the portion of the recording paper 2 that is positioned near the tension bar 22 at any pivot angle θ, as viewed in the axial direction of the support shaft 33R. As a result, the support arms 23L and 23R are prevented from jutting outward from the recording paper 2. Therefore, while the above-described advantageous effects are obtained, the size of the support arms 23L and 23R are also kept smaller.

For example, as illustrated in FIG. 5B, when the center 33*c* of the support shaft 33R deviates greatly downward from the center 21*c* of the take-up shaft 21, the tension bar 22 cannot be moved to a predetermined upper limit position unless the angle θ3 of the support arm 23R relative to the horizontal line is set to be large. However, the present preferred embodiment makes it possible to keep the angle θ4 of the support arm 23R relative to the horizontal line smaller, as illustrated in FIG. 5A. In the present preferred embodiment, the support arm 23R is configured so as to pivot between the position at an angle of about 45 degrees downward from the horizontal line and the position at an angle of about 45 degrees upward therefrom, for example, as viewed in the axial direction of the support shaft 33R, during printing with the printer 1. Even in such a pivot range, the tension bar 22 is moved to the predetermined upper limit position and the predetermined lower limit position.

Figure 7:
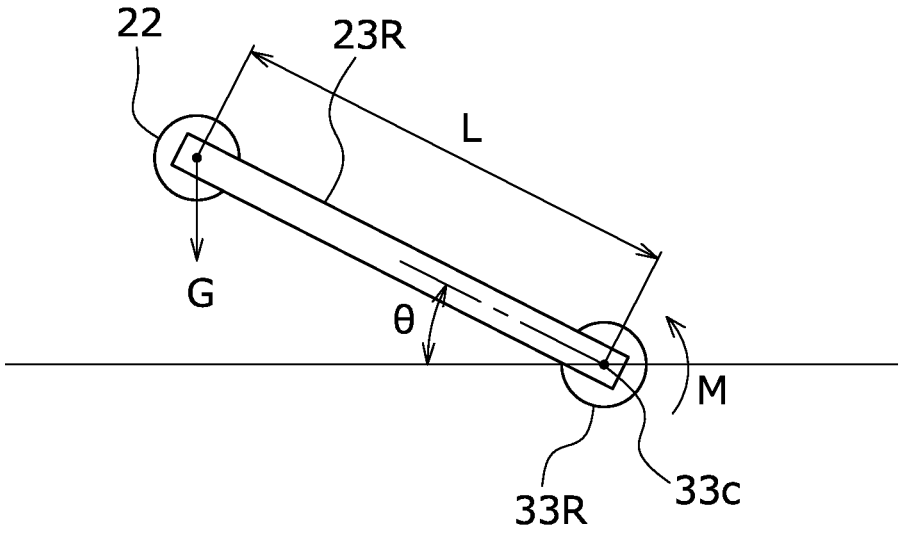
FIG. 7 is a graph illustrating the moment acting on a support arm.

As illustrated in FIG. 7, the moment M that acts on the support arm 23R can be represented as $M=G\cdot\cos\theta$, where G is the weight of the tension bar 22 and so forth, L is the length of the support arm 23R, and θ is the angle of the support arm 23R relative to the horizontal line. Therefore, the less the angle θ of the support arm 23R, the greater the moment M of the support arm 23R. The position or the position range of the tension bar 22 during printing with the printer 1 is set in advance, and the value or the range of the angle θ of the support arm 23R (hereinafter referred to as the use angle θ of the support arm 23R) is also set in advance accordingly. Here, if the use angle θ of the support arm 23R is smaller than that in the conventional printers, the moment M acting on the support arm 23R becomes greater than in the conventional cases, so the tension imparted to the recording paper 2 may become greater than in the conventional cases. However, the printer 1 according to the present preferred embodiment includes the torsion spring 34 configured to impart a force to the support arm 23R in a direction such as to pivot the support arm 23R upward. The tension bar 22 receives an upward force from the torsion spring 34 via the support arm 23R. As a result, the printer 1 according to the present preferred embodiment maintains the tension imparted to the recording paper 2 at almost the same level as in the conventional cases, even though the use angle θ of the support arm 23R is small.

It is also possible to use any other spring in place of the torsion spring 34, for example. However, when the torsion spring 34 is used, the spring can be installed by fitting it into the support shaft 33R, as illustrated in FIG. 4. Thus, with the use of the torsion spring 34, the advantageous effects are obtained and the spring is disposed in a compact manner.

As illustrated in FIG. 3, the printer 1 includes the first left side wall 31L supporting the left end portion of the take-up shaft 21, the first right side wall 31R supporting the right end portion of the take-up shaft 21, the second left side wall 32L supporting the support arm 23L, and the second right side wall 32R supporting the support arm 23R. As a result, the support arms 23L, 23R and the take-up shaft 21 are stably supported while allowing a position of the center 21*c* of the take-up shaft 21 and a position of the center of the support shafts 33L and 33R pivotably supporting the support arms 23L and 23R to be in agreement with each other.

The left support arm 23L includes the first left vertical arm portion 23L1 connected to the left support shaft 33L and extending upward, the left horizontal arm portion 23L2 extending rightward from the first left vertical arm portion 23L1, and the second left vertical arm portion 23L3 extending upward from the left horizontal arm portion 23L2. The right support arm 23R has the first right vertical arm portion 23R1 connected to the right support shaft 33R and extending upward, the right horizontal arm portion 23R2 extending leftward from the first right vertical arm portion 23R1, and the second right vertical arm portion 23R3 extending upward from the right horizontal arm portion 23R2. The tension bar 22 is supported by the second left vertical arm portion 23L3 and the second right vertical arm portion 23R3.

With such a configuration, the supporting portion of the left support arm 23L for the tension bar 22 (i.e., the second vertical arm portion 23L3) preferably is positioned rightward relative to the portion of the left support arm 23L that is supported by the support shaft 33L (i.e., the first vertical arm portion 23L1). Likewise, the supporting portion of the right support arm 23R for the tension bar 22 (i.e., the second vertical arm portion 23R3) preferably is positioned leftward relative to the portion of the right support arm 23R that is supported by the support shaft 33R (i.e., the first vertical arm portion 23R1). As a result, the length of the tension bar 22 is easily shortened, even though the second left side wall 32L supporting the support arm 23L is disposed to the left of the first left side wall 31L and the second right side wall 32R supporting the support arm 23R is disposed to the right of the first right side wall 31R so that the gap between the support shaft 33L and the support shaft 33R is set large. The size of the tension bar 22 is significantly reduced. Moreover, since the length of the tension bar 22 is kept short, the weight of the tension bar 22 is reduced. As a result, it is possible to even more reliably prevent the change in the tension of the recording paper 2 that results from the pivoting of the support arms 23L and 23R.

In the printer 1 according to the present preferred embodiment, the motor 25 configured to drive the take-up shaft 21 is disposed behind the right horizontal arm portion 23R2 and between the first right side wall 31R and the second right side wall 32R. This makes it possible to avoid the interference between the support arm 23R and the motor 25. Moreover, the space behind the horizontal arm portion 23R2 is efficiently utilized as the space to install the motor 25, so the motor 25 is disposed in a compact manner.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A printer comprising:

a platen supporting a sheet-shaped recording medium that is delivered frontward during printing;

a take-up shaft on which the recording medium having been printed is wound;

a tension bar configured to impart tension to the recording medium by pressing a portion of the recording medium between the platen and the take-up shaft;

a support arm supporting the tension bar;

a support shaft pivotably supporting the support arm; and a spring configured to impart a force to the support arm in a direction so as to pivot the support arm upward; wherein a center of the support shaft is positioned inside a contour of the take-up shaft as viewed in an axial direction of the support shaft.

2. The printer according to claim 1, wherein a position of the center of the support shaft and a position of a center of the take-up shaft are in agreement or substantially in agreement with each other as viewed in the axial direction of the support shaft.

3. The printer according to claim 1, wherein:

the take-up shaft and the tension bar extend transversely;

the tension bar is disposed frontward relative to the platen and frontward relative to the take-up shaft; and the support shaft is positioned rearward relative to a portion of the recording medium that is in contact with the tension bar.

4. The printer according to claim 1, wherein:

the take-up shaft and the tension bar extend transversely;

the tension bar is disposed frontward relative to the platen and frontward relative to the take-up shaft; and the support arm is positioned rearward relative to a portion of the recording medium that is in contact with the tension bar.

5. The printer according to claim 1, wherein the support arm is configured to pivot between a position at an angle of about 45 degrees downward from a horizontal line and a position at an angle of about 45 degrees upward from the horizontal line during printing, as viewed in the axial direction of the support shaft.

6. The printer according to claim 1, wherein the spring is a torsion spring fitted to the support shaft.

7. The printer according to claim 1, further comprising:

a pair of the support shafts and a pair of the support arms provided at left and right positions respectively;

a first left side wall rotatably supporting a left end portion of the take-up shaft;

a first right side wall rotatably supporting a right end portion of the take-up shaft;

a second left side wall disposed leftward of the first left side wall; and a second right side wall disposed rightward of the first right side wall; wherein the left support shaft is provided on a right side portion of the second left side wall, and the right support shaft is provided on a left side portion of the second right side wall.

8. The printer according to claim 7, wherein:

the left support arm includes a first left vertical arm portion connected to the left support shaft and extending upward, a left horizontal arm portion extending rightward from the first left vertical arm portion, and a second left vertical arm portion extending upward from the left horizontal arm portion;

the right support arm includes a first right vertical arm portion connected to the right support shaft and extending upward, a right horizontal arm portion extending leftward from the first right vertical arm portion, and a second right vertical arm portion extending upward from the right horizontal arm portion; and the tension bar is supported by the second left vertical arm portion and the second right vertical arm portion.

9. The printer according to claim 8, further comprising a motor disposed behind the right horizontal arm portion and between the first right side wall and the second right side wall, or disposed behind the left horizontal arm portion and between the first left side wall and the second left side wall, wherein the motor is connected to the take-up shaft.

10. The printer according to claim 1, further comprising:

an inkjet-type recording head including a plurality of nozzles configured to eject ink onto one surface of the recording medium; and wherein the tension bar is configured to come into contact with a surface of the recording medium that is opposite to the one surface of the recording medium.

11. A recording medium take-up mechanism comprising:

a take-up shaft on which a sheet-shaped recording medium is wound;

a tension bar configured to impart tension to the recording medium by pressing a portion of the recording medium that is upstream of the take-up shaft;

a support arm supporting the tension bar;

a support shaft pivotably supporting the support arm; and a spring configured to impart a force to the support arm in a direction so as to pivot the support arm upward; wherein a center of the support shaft is positioned inside a contour of the take-up shaft as viewed in an axial direction of the support shaft.

12. The recording medium take-up mechanism according to claim 11, wherein the tension bar is configured to come into contact with a surface of the recording medium opposite to the surface thereof to be printed.

13. The recording medium take-up mechanism according to claim 11, wherein a position of the center of the support shaft and a position of a center of the take-up shaft are in agreement or substantially in agreement with each other as viewed in the axial direction of the support shaft.

14. The recording medium take-up mechanism according to claim 11, wherein:

the take-up shaft and the tension bar extend transversely;

the tension bar is disposed frontward relative to the take-up shaft; and the support shaft is positioned rearward relative to a portion of the recording medium that is in contact with the tension bar.

15. The recording medium take-up mechanism according to claim 11, wherein:

the take-up shaft and the tension bar extend transversely;

the tension bar is disposed frontward relative to the take-up shaft; and the support arm is positioned rearward relative to a portion of the recording medium that is in contact with the tension bar.

16. The recording medium take-up mechanism according to claim 11, wherein the support arm is configured to pivot between a position at an angle of about 45 degrees downward from a horizontal line and a position at an angle of about 45 degrees upward from the horizontal line during printing, as viewed in the axial direction of the support shaft.

17. The recording medium take-up mechanism according to claim 11, wherein the spring is a torsion spring fitted to the support shaft.

* * * * *